United States Patent [19]

Murphy et al.

[11] Patent Number: 4,946,340

[45] Date of Patent: Aug. 7, 1990

[54] DUNNAGE HANDLING SYSTEM

[75] Inventors: James F. Murphy; John A. Wiseman, both of Lynchburg, Va.

[73] Assignee: Simplimatic Engineering company, Lynchburg, Va.

[21] Appl. No.: 252,803

[22] Filed: Sep. 30, 1988

[51] Int. Cl.[5] ..... B65G 60/00

[52] U.S. Cl. ..... 414/788.8; 414/795.8; 414/796.7; 414/796.9; 414/793.5; 414/416; 294/87.1

[58] Field of Search ..... 414/795.8, 796.7, 796.9, 414/788.8, 928, 929, 794.4, 794.8, 793.5, 794.3, 416; 294/87.1

[56] References Cited

U.S. PATENT DOCUMENTS

| | | | |
|---|---|---|---|
| 2,727,642 | 12/1955 | Haycock | 414/416 |
| 2,799,414 | 7/1957 | Streckfuss | 414/416 |
| 2,815,870 | 12/1957 | Laub, III | 414/793.5 X |
| 3,101,851 | 8/1963 | Heide et al. | 414/788.8 X |
| 3,471,038 | 10/1969 | Veerinder | 414/793.5 |
| 3,517,835 | 6/1970 | Temple | 214/8.5 |
| 3,529,732 | 9/1970 | Wayne | 414/793.5 |
| 3,647,093 | 3/1972 | Brooks | 414/796.9 X |
| 3,682,338 | 8/1972 | Von Gal et al. | 214/8.5 D |
| 3,749,257 | 7/1973 | Yamashita | 414/796.7 |
| 3,780,884 | 12/1973 | Jones | 214/8.5 D |
| 3,917,082 | 11/1975 | Howard et al. | 214/8.5 D |
| 4,214,848 | 7/1980 | Verwey et al. | 414/77 |
| 4,302,142 | 11/1981 | Kuhl et al. | 414/795.8 |
| 4,355,936 | 10/1982 | Thomas et al. | 414/118 |
| 4,358,236 | 11/1982 | Dudley | 414/96 |
| 4,486,045 | 12/1984 | Trygg | 294/87.1 |
| 4,541,762 | 9/1985 | Tischler et al. | 414/32 |
| 4,557,656 | 12/1985 | Ouellette | 414/796.7 X |
| 4,588,341 | 5/1986 | Motoda | 414/32 |
| 4,720,228 | 1/1988 | Horiguchi et al. | 414/788.81 |

FOREIGN PATENT DOCUMENTS

| | | | |
|---|---|---|---|
| 318102 | 1/1957 | Switzerland | 414/416 |

*Primary Examiner*—Michael S. Huppert
*Assistant Examiner*—Boris Milef
*Attorney, Agent, or Firm*—St. Onge Steward Johnson & Reens

[57] ABSTRACT

A device is provided for unloading parts from a plurality of stacked trays. The device includes a receiving station with an elevator for lifting a topmost tray to a predetermined position; a temporary holder for the topmost tray while the elevator lowers the remaining trays a preselected distance; a conveyor for moving from an initial position to below the topmost tray; the temporary holder further for releasing the topmost tray onto the conveyor for conveying to an unloading station; an unloader disposed above the topmost tray to unload it; an additional elevator for receiving the topmost tray after unloading; and the conveyor further for returning to the initial position to receive the next topmost tray.

32 Claims, 13 Drawing Sheets

DUNNAGE HANDLING SYSTEM

FIELD OF THE INVENTION

This invention relates generally to materials handling, and specifically to an apparatus and a method for handling a stack of dunnage trays and for unloading parts stored in individual trays.

BACKGROUND OF THE INVENTION

Automated article handling and unloading systems are generally known in the art.

By way of example only, the following patents incorporate a variety of features in materials handling methods and systems:

| | |
|---|---|
| 4,588,341 Motoda | 4,541,762 Tischler et al. |
| 4,358,236 Dudley | 4,355,936 Thomas et al. |
| 4,214,848 Verwey et al. | 3,917,082 Howard et al. |
| 3,780,884 Jones | 3,682,338 Von Gal et al. |
| 3,517,835 Temple. | |

SUMMARY OF THE INVENTION

Briefly stated, this invention is directed to an apparatus and a method for handling a stack of dunnage trays to unload parts stored in the individual trays and thereafter restack the empty trays.

One preferred embodiment of this invention comprises a receiving station with elevator means for lifting a stack of trays to a predetermined vertical position, means for temporarily holding a topmost tray at said position, conveying means for moving between the topmost tray and remaining stack for moving the topmost tray under an unloading station, means for indexing successive rows of the top tray to an unloading position, means for unloading parts from the top tray, means for restacking the empty top tray, means for lowering the restacked stack, and means for controlling to repeat the unloading of every tray in the stack.

It is an object of the present invention to provide a dunnage handling and unloading system by which a dunnage tray having parts stored therein may be unloaded.

It is a further object of this invention to provide a dunnage handling and unloading system that outputs empty dunnage trays in an orderly manner.

These and other objects and advantages of the invention will become more apparent from the following detailed description when considered in conjunction with the accompanying drawings and appended claims.

DETAILED DESCRIPTION OF THE INVENTION

Figure 1:
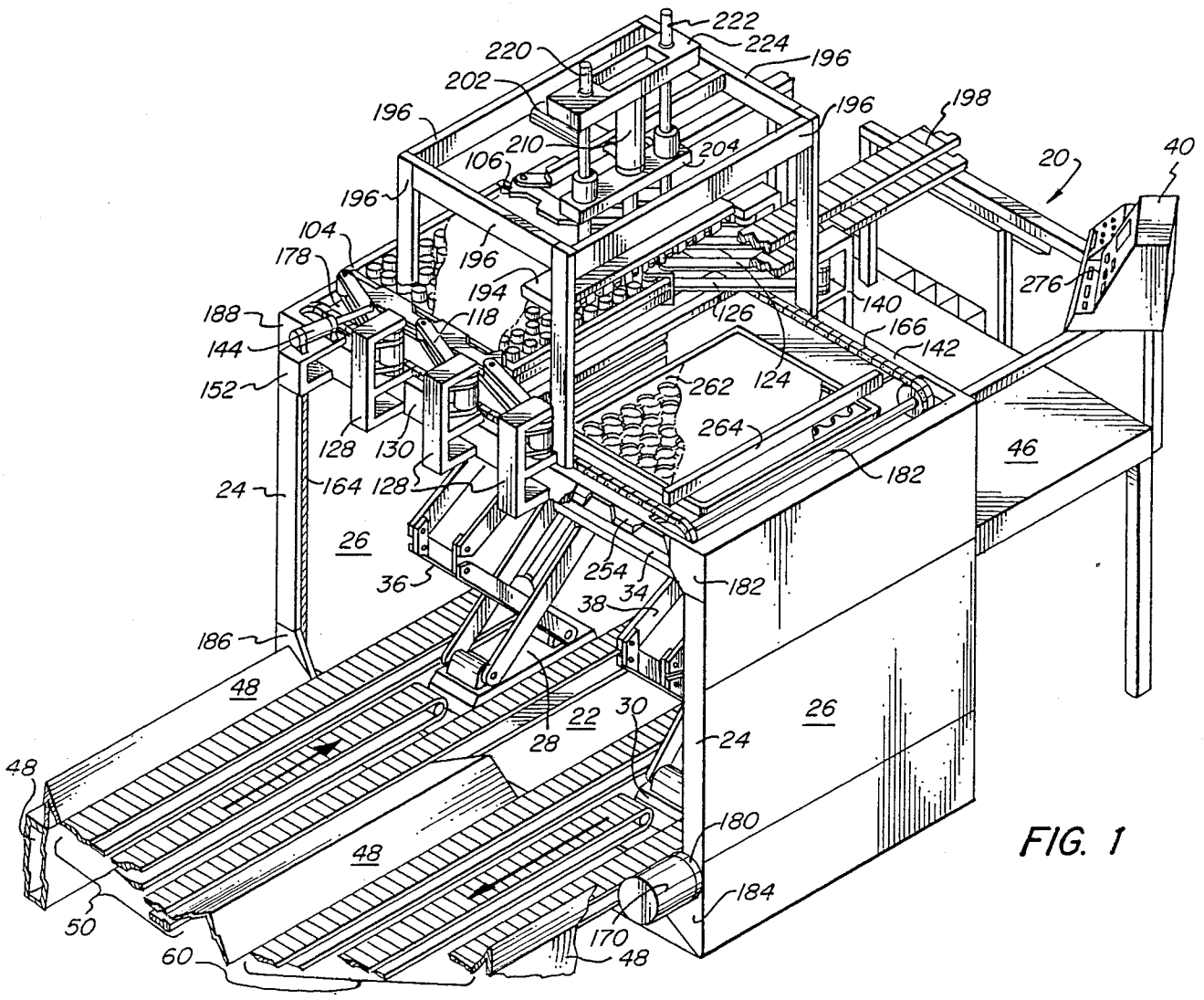
FIG. 1 is a perspective view of the preferred apparatus of this invention.
Figure 2:
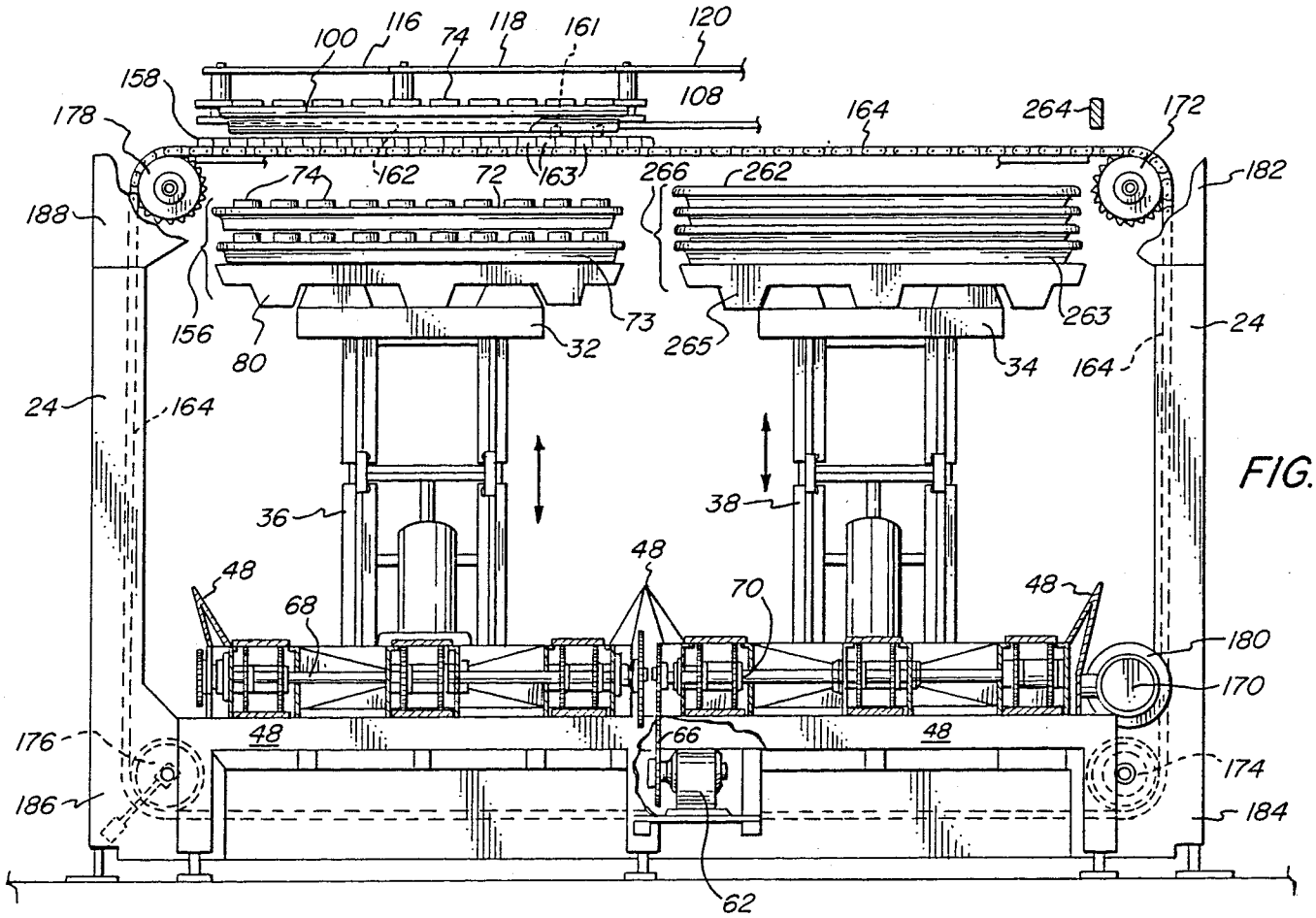
FIG. 2 is a front elevational view of the apparatus of FIG. 1.
Figure 9:
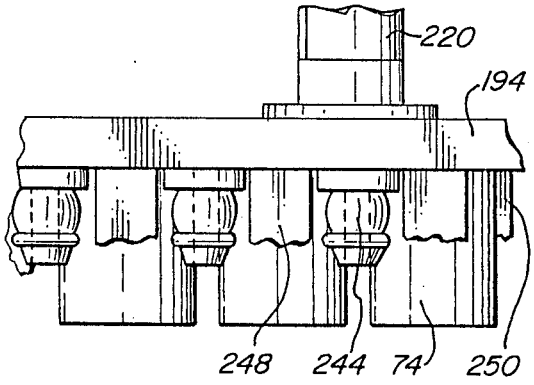
FIG. 9 is an enlarged side view of the unload head of the apparatus of FIG. 1.
Figure 10:
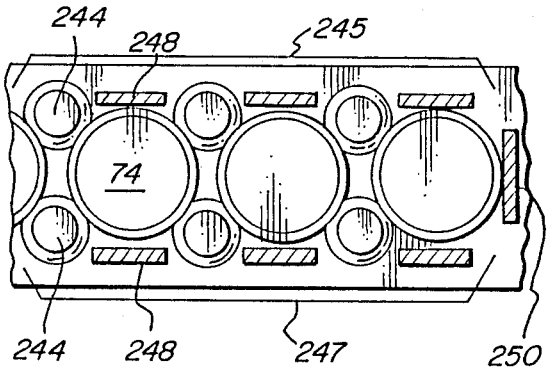
FIG. 10 is an enlarged bottom view of the unload head of the apparatus of FIG. 1.
Figure 11:
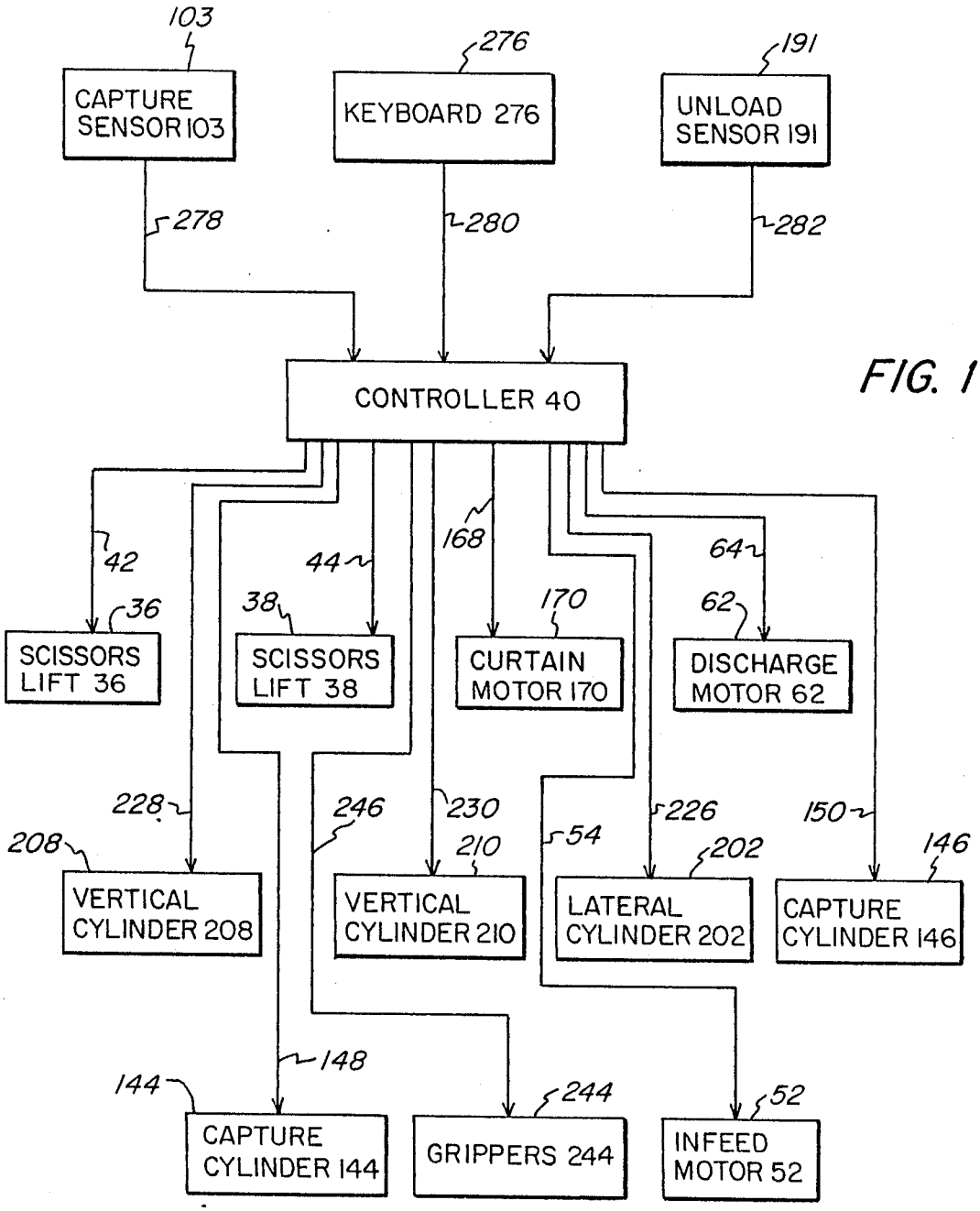
FIG. 11 is a schematic block diagram of the controller of the apparatus of FIG. 1.

With reference to FIGS. 1 through 11 and especially FIG. 1, a dunnage handling and unloading apparatus 20 in accordance with the present invention is shown. Apparatus 20 includes a base 22, a main frame 24, and side walls 26. Base 22 supports an elevating platform 28 and a lowerating platform 30. Both elevating platform 28 and lowerating platform 30 each include, in accordance with the preferred embodiment, tray supports 32 and 34 and scissors lifts 36 and 38 respectively as seen in FIG. 2. Scissors lifts 36 and 38 are routinely actuable by a controller 40 via respective lines 42 and 44 as shown in FIG. 11. Controller 40 is preferably mounted on a control station 46 at the rear of main frame 24 and functions as shown schematically in FIG. 11. Conveyor support 48 supports infeed conveyor 50 and discharge conveyor 60.

Figure 5:
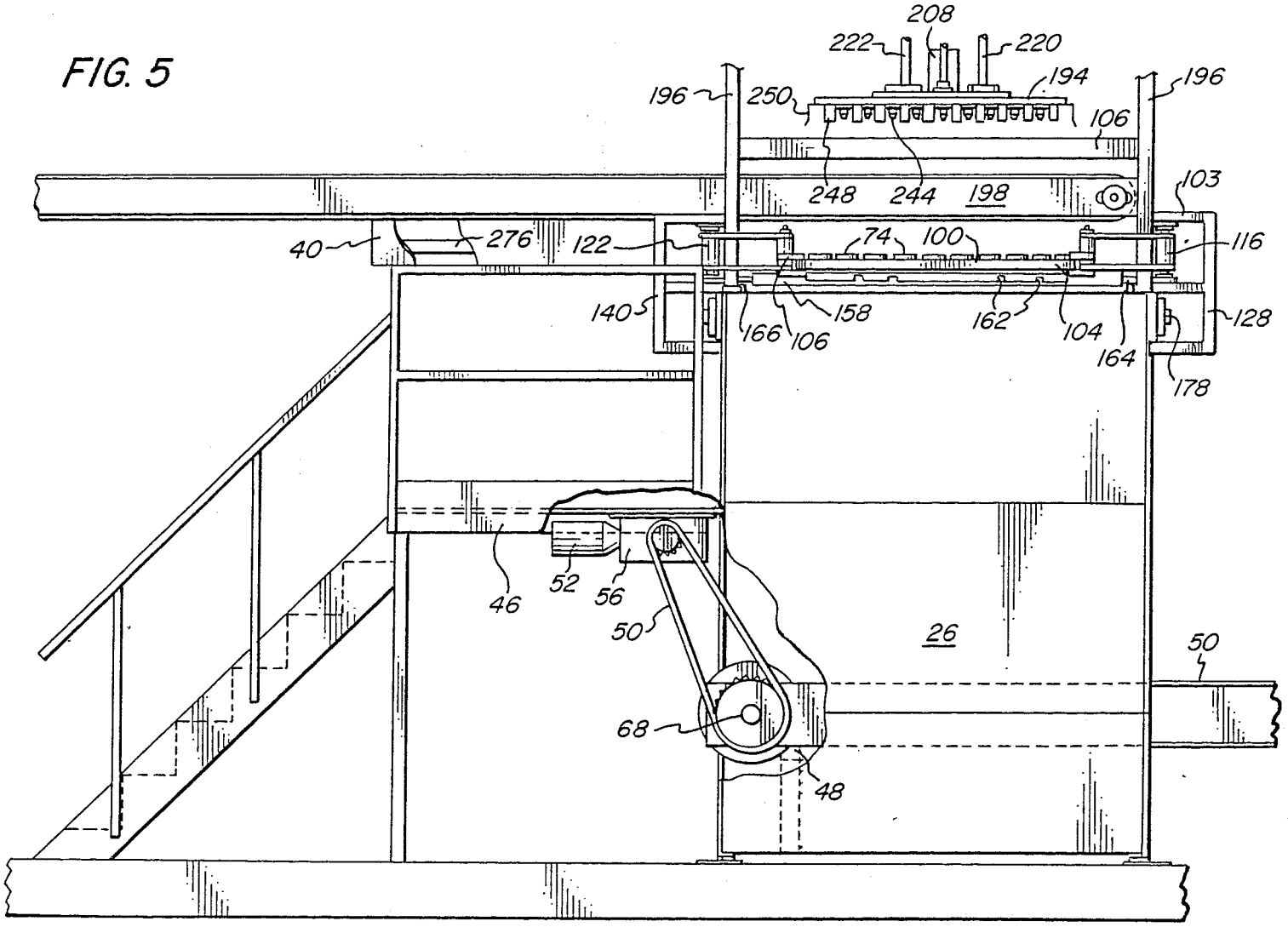
FIG. 5 is a side elevational view of the apparatus of FIG. 1.

Referring now to FIG. 5, infeed conveyor 50 is routinely driven by motor 52 through a reducer 56, a belt 58, and axled sprocket 68. Motor 52 is mounted to and beneath control station 46 and is operatively connected to controller 40 along line 54 as shown by FIG. 11.

Figure 3:
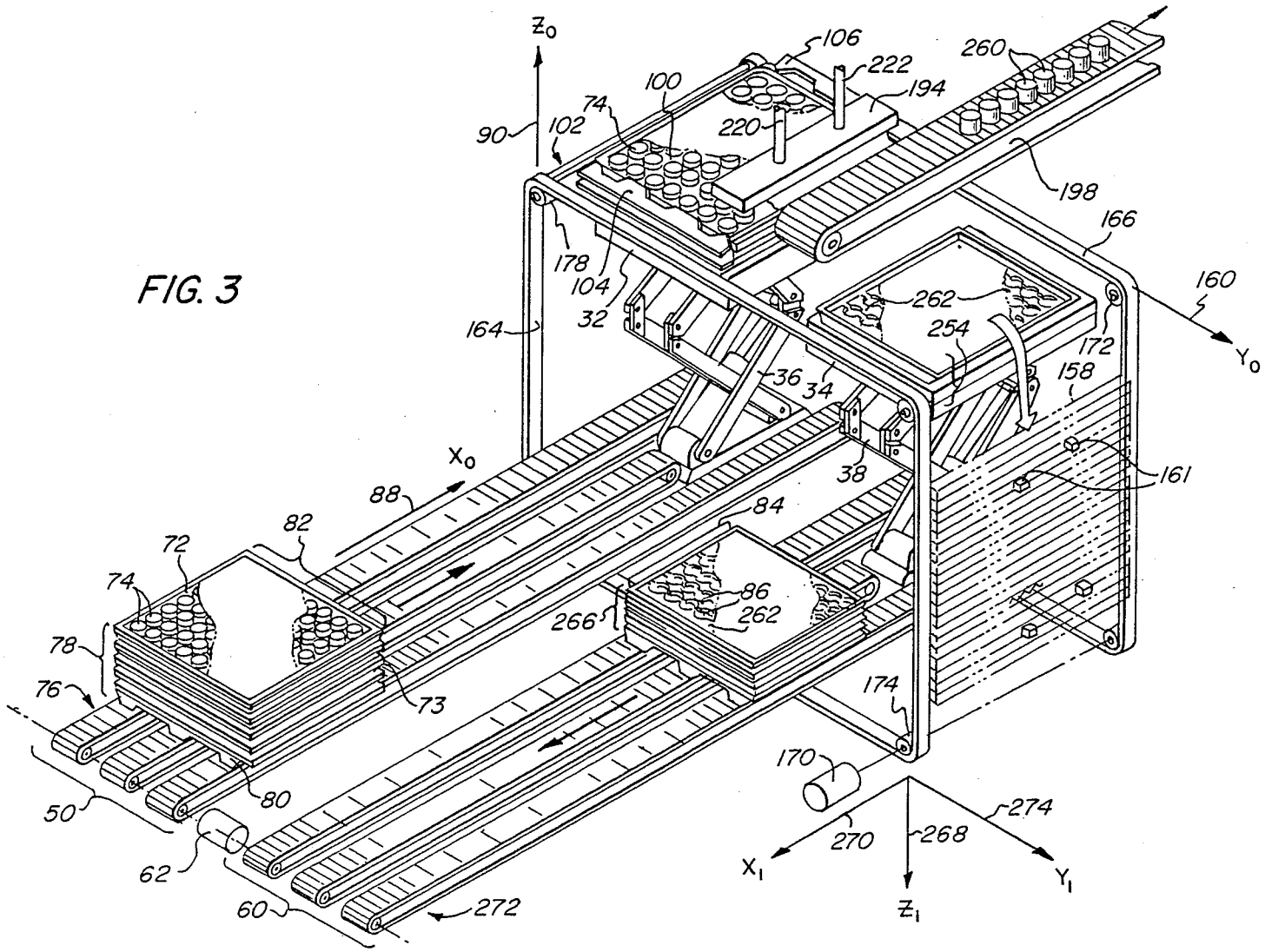
FIG. 3 is a schematic perspective view of the apparatus of FIG. 1.

Referring to FIGS. 2 and 3, which have parts of the structure of FIG. 1 removed to more clearly show underlying detail, discharge conveyor 60 is driven by a motor 62 through a belt 66 and axled sprocket 70 and is operatively connected to controller 40 along line 64 as shown by FIG. 11.

A dunnage tray 72 containing parts 74 stored therein, such as for example compressor wheels or other workpieces, is provided to apparatus 20 at an input station 76 adjacent the end of infeed conveyor 50. A stack 78 of k number of dunnage trays 72 resting upon a mother pallet 80 is typically provided by way of example only, with each dunnage tray 72 containing parts 74 preferably stored in m number of substantially parallel rows 82 and n number of substantially parallel columns 84. Dunnage trays 72 typically have formed therein compartments 86 for holding parts 74. Further, dunnage tray 73 on the bottom of stack 78 is typically provided, by way of example only, as attached to mother pallet 80 to increase the stability of stack 78.

Infeed conveyor 50 is actuable by controller 40 to convey stack 78 of dunnage trays 72 from input station 76 along a path $x_0$ indicated at 88 to elevating platform 28. In the preferred embodiment described here, path $x_0$ is substantially parallel to rows 82 of parts in dunnage trays 72, although it is understood that the columns 84 could be so aligned with $x_0$ instead. Elevating platform 28 is actuable by controller 40 to lift stack 78 along a vertical path $z_0$ indicated at 90 substantially perpendicular to path $x_0$ from infeed conveyor 50 to a tray capturing station 102 lying just above main frame 24. Tray capture sensor 103, which can be any routine sensor such as for example a photoelectric sensor, is operatively connected to controller 40 through line 278 as shown in FIG. 11 and halts elevating platform 28 when a dunnage tray, here the topmost or $k^{th}$ dunnage tray 100 by way of example only, is adjacent capturing station 102.

Figure 4:
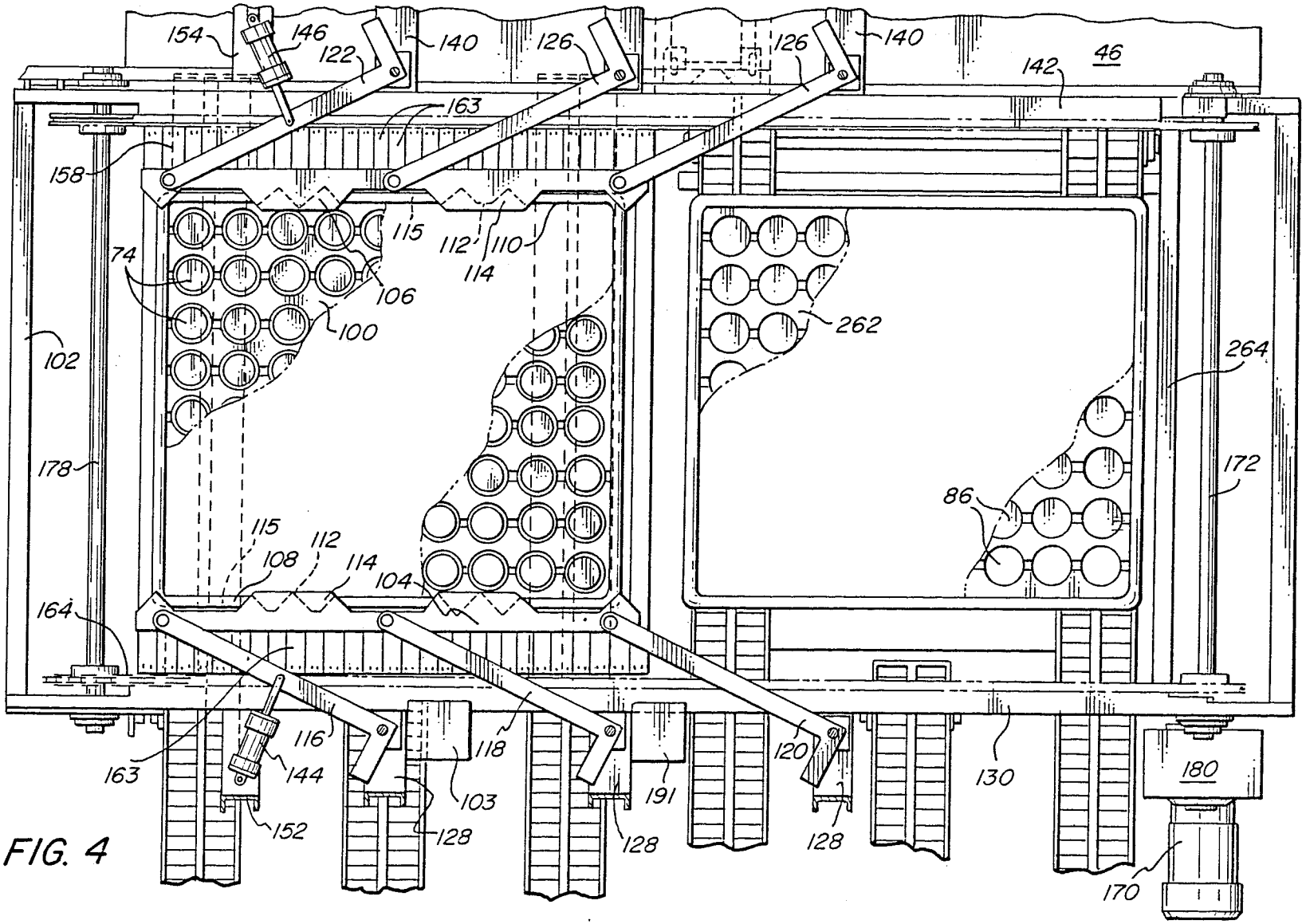
FIG. 4 is an enlarged partial top plan view of the apparatus of FIG. 1.
Figure 5A:
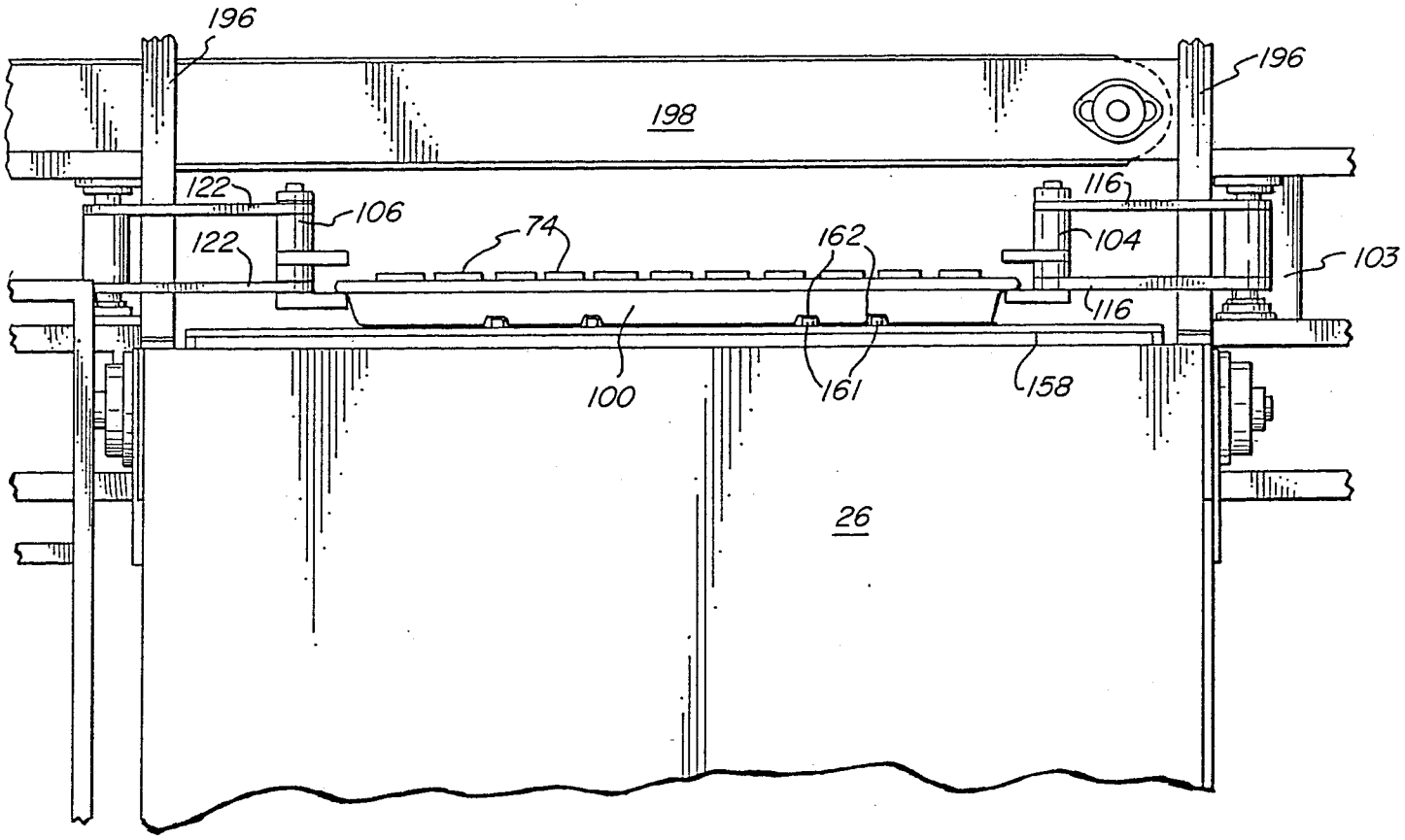
FIG. 5A is a partial side view of the apparatus of FIG. 1 with a captured tray.

Referring now to FIG. 4, an enlarged top view of capturing station 102 is shown. Capturing station 102 includes two bars 104 and 106 formed to move inwardly to engage opposite sides 108 and 110 of dunnage tray 100 and hold it in a relatively fixed position along vertical path $z_0$. Because the dunnage tray on the bottom of the stack is typically fixedly attached to the mother pallet, the capturing station must be able to capture and hold not only the trays simply stacked on top of each other, but must also be able to capture and hold the last tray in the stack along with the mother pallet, which are attached each to the other. Therefore, two sets of teeth are provided, one set for gripping the stacked trays one at a time and the other set for gripping the last tray and mother pallet. Accordingly, bars 104 and 106 are each provided with two sets of teeth 112 and 114. Teeth 112 are triangular in shape, lie below teeth 114, and move inwardly as bars 104 and 106 move in parallelogram fashion to engage each dunnage tray 100 under a lip 115 formed in dunnage tray 100. See also FIG. 5A. Teeth 114 are trapezoidal in shape, lie above teeth 112 and also move inwardly as bars 104 and 106 move in parallelogram fashion to engage mother pallet 80 with attached dunnage tray 101. See also FIG. 5A.

Further, bars 104 and 106 are each pivotally attached to three pairs of pivot arms. Pivot arms 116, 118, and 120 are attached to bar 104; and pivot arms 122, 124, and 126 are attached to bar 106. Pivot arms 116, 118, and 120 are each mounted to brackets 128 attached to an upper cross piece 130 of main frame 24. Similarly, pivot arms 122, 124, and 126 are each mounted to brackets 140 attached to upper cross piece 142 of main frame 24. The uppermost pivot arm of pivot arm pairs 116 and 122 are moved by capture cylinders 144 and 146 respectively. Capture cylinders 144 and 146 are actuable by controller 40 via lines 148 and 150. Brackets 152 and 154, which are also attached to respective upper cross pieces 130 and 142 of main frame 24, support capture cylinders 144 and 146.

Figure 5B:
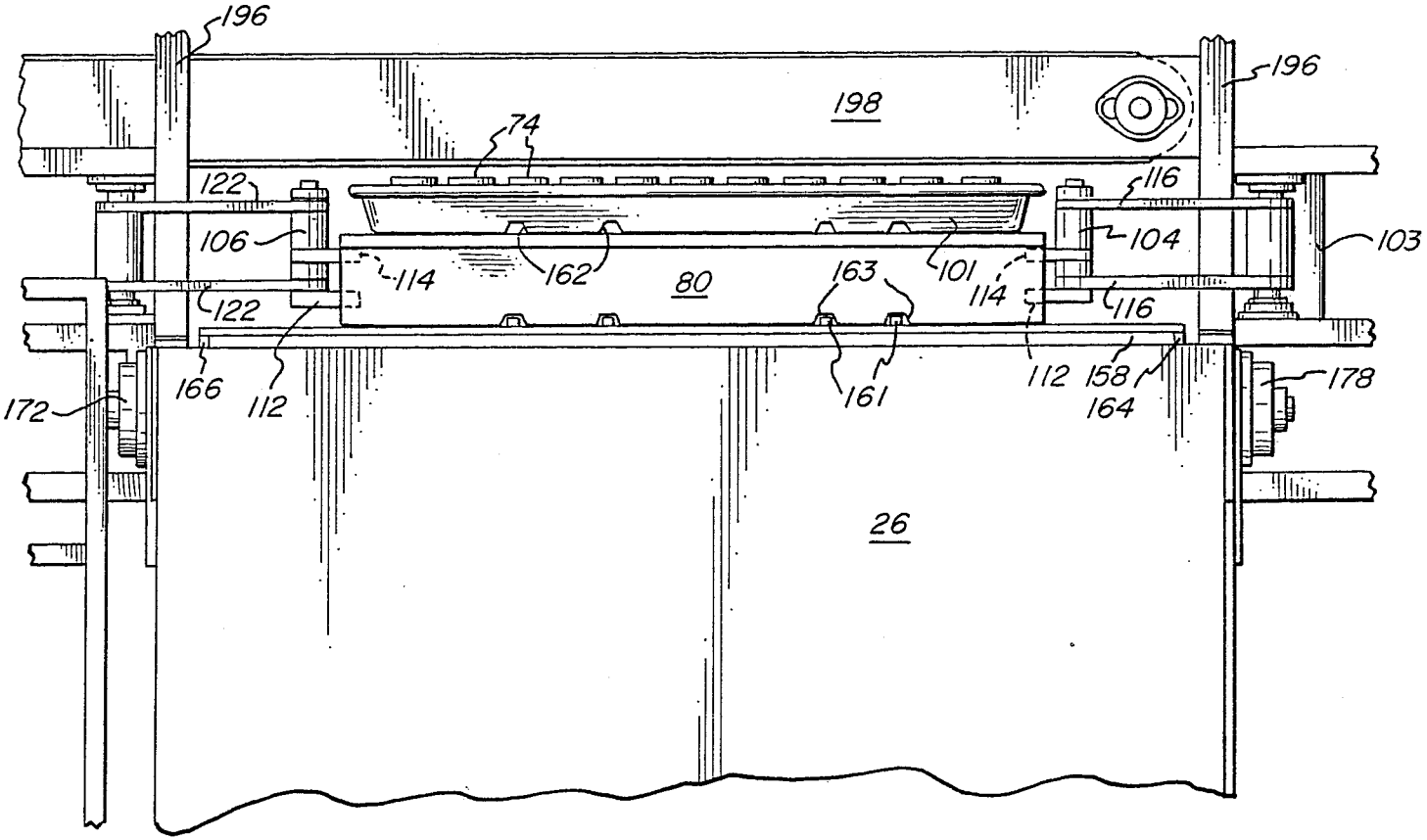
FIG. 5B is a partial side view of the apparatus of FIG. 1 with a captured mother pallet and attached tray.

Referring back to FIG. 2, once dunnage tray 100 has been captured by bars 104 and 106, elevating platform 28 lowers the remaining dunnage trays 72 and dunnage tray 73 with attached mother pallet 80 back along vertical path $z_0$ to separate dunnage tray 100 from the remaining stack 156 of $(k-1)$ dunnage trays. Alternatively, once dunnage tray 101 has been captured, elevating platform 28 lowers to separate from it. A conveying means such as curtain 158 (See also FIGS. 3 and 4) is then inserted beneath dunnage tray 100 or dunnage tray 101 along a path $y_0$, indicated at 160 substantially perpendicular to both path $x_0$ and path $z_0$. Conveying curtain 158 includes alignment lugs 161 which engage alignment troughs 162 (see also FIGS. 5A and 5B) on dunnage tray 100 and alignment troughs 163 on mother pallet 80 with attached dunnage tray 101 to align columns 84 substantially parallel to path $y_0$. Bars 104 and 106 are then disengaged from opposite sides 108 and 110 of $k^{th}$ dunnage tray 100 or from beneath mother pallet 80 by controller 40 along respective lines 148 and 150 to release either onto conveying curtain 158 in aligned fashion.

In accordance with the preferred embodiment, conveying curtain 158 is constructed of a number of individual slats 163 that have their ends attached to drive chains 164 and 166. Slats 163 are preferably formed so as to provide longitudinal rigidity, and further have their edges substantially in abutment one with the other in order to properly support rather flexible dunnage trays 100 for unloading. See also FIGS. 3 and 4. Drive chains 164 and 166 are both driven by motor 170 through reducer 180 and, by way of example, four axled sprockets 172, 174, 176, and 178 which extend rearwardly from each of the four front corners 182, 184, 186, and 188 of main frame 24. Motor 170 is operable under the direction of controller 40 along line 168. Conveying curtain 158 is thus capable of repeated circulation about main frame 24 to convey dunnage tray 100 or 101 from capturing station 102 to an unload station 190 shown in more detail in FIG. 6. Unload sensor 191 is in communication with controller 40 to stop conveying curtain 158 when part 74 reaches an unload position 192 at unloading station 190 as discussed in more detail below in conjunction with FIG. 7.

Figure 6:
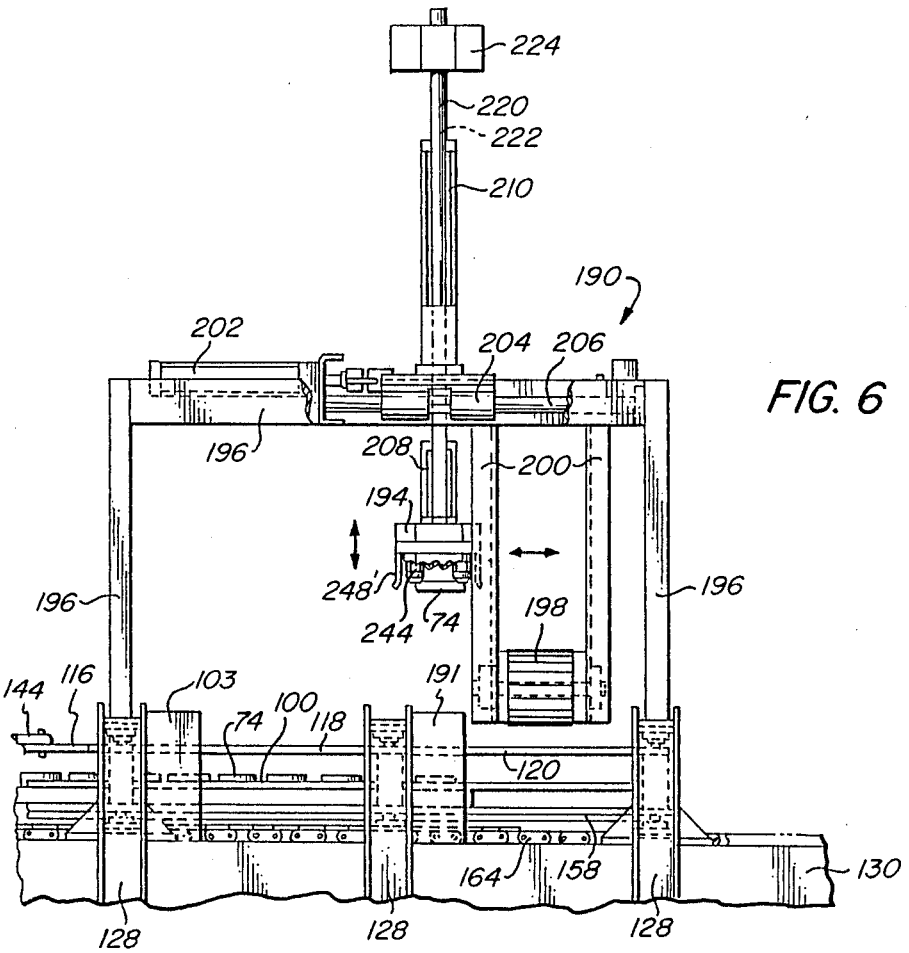
FIG. 6 is a front view of the upper frame of the apparatus of FIG. 1.

Referring now to FIG. 6, a front view of unloading station 190 is shown. Unloading station 190 includes an unloading head 194 suspended below the top of an upper frame 196, which is mounted to the upper cross pieces 130 and 142 of main frame 24. Transport conveyor 198 is also suspended by supports 200 below the top of upper frame 196. Unloading head 194 is moved from dunnage tray 100 or 101 to transport conveyor 198 which transports unloaded parts 260 to additional workstations in routine fashion. Cylinder 202 moves unloading head 194 by sliding unload head carriage 204 along guide shaft 206. Similarly, vertical cylinders 208 and 210 move unloading head 194 along guide shafts 220 and 222, which are attached to unloading head 194 and pass through unload head carriage 204. Guide shafts 220 and 222 are stabilized by stabilizer 224. See also FIG. 8 which is a side view of unloading station 190.

Figure 7:
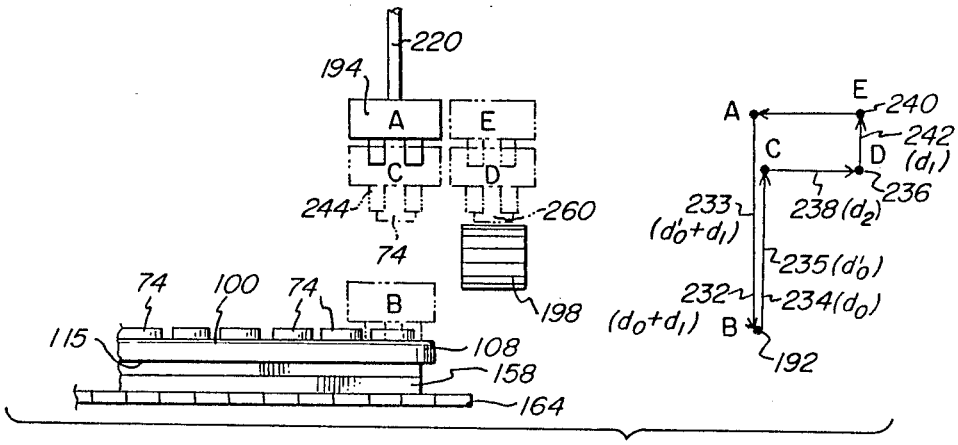
FIG. 7 is a schematic front view of the unload head of the apparatus of FIG. 1.
Figure 8:
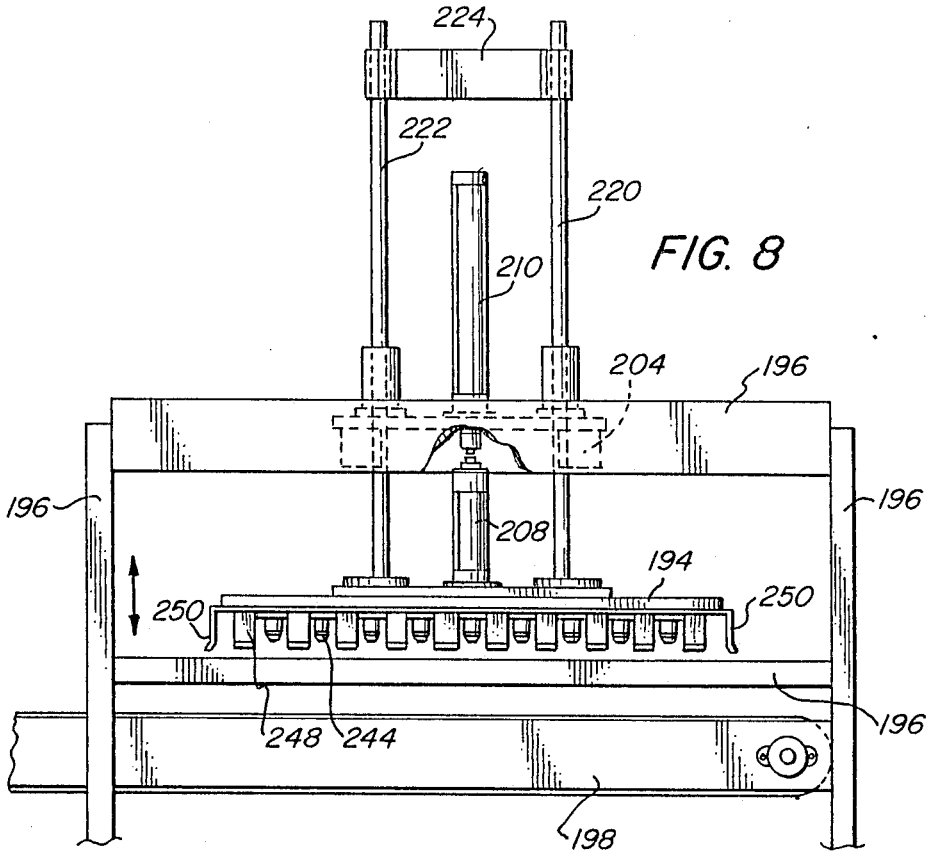
FIG. 8 is a side view of the upper frame of the apparatus of FIG. 1.

Referring now to FIG. 7, a schematic view of the unloading motion of unload head 194 is shown. Cylinders 202, 208, and 210 are actuable by controller 40 via respective lines 226, 228, and 230 to move unload head 194 through five positions labeled A through E. Position A is attained by retracting all three cylinders 202, 208, and 210. Unload position 192 at unload station 190 located at position B is attained by extending both vertical cylinders 208 and 210 to drop unload head 194 from position A a distance equivalent to $(d_0+d_1)$ 232 for dunnage tray 100 or a distance equivalent to $(d_{0'}+d_1)$ 233 for dunnage tray 101 with attached mother pallet 80. Distance $d_0$ is substantially equivalent to distance $d_{0'}$ plus the height of mother pallet 80.

Position C is attained from position B by retracting cylinder 210 to raise unload head 194 a distance $d_0$ 234 to the height of transport conveyor 198 for dunnage tray 100 or a distance $d_{0'}$ 235 for dunnage tray 101 with attached mother pallet 80. A transport conveyor position 236 located at position D is attained by extending transverse cylinder 202 to move unload head 194 a distance $d_2$ 238 from position C. Finally, a head clear position 240 is attained from position D by retracting cylinder 208 to raise unload head 194 a distance $d_1$ 242 above transport conveyor 198.

Conveying curtain 158 conveys dunnage tray 100 or 101 from capturing station 102 to bring successive rows of compartments 86 into alignment with unloading position 192. Parts 74 are gripped by unloading head 194, moved to transport conveyor 198 and deposited.

Referring now to FIGS. 9 and 10, enlarged side and bottom views of unloading head 194 with gripped parts 74 are shown. Unloading head 194 grips parts 74 with bladder grippers 244 that inflate via air line 246 under direction of controller 40. Bladder grippers 244 are arranged in two rows 245 and 247 on either side of parts 74. To insure parts 74 are positioned between rows 245 and 247 of bladder grippers 244, guide flanges 248 and 250 respectively on the sides and ends of unload head 194 help align parts 74 for gripping by bladder grippers 244. Guide flanges 248 on the sides of unload head 194 are interstitially placed between consecutive bladder grippers 244 of rows 245 and 247. A part 74 in the middle of a row 82 of compartments 86 which is properly aligned and ready for gripping will have a guide flange 248 on either side and four bladder grippers 244 surrounding it. A part 74 at the end of a row 82 of compartments 86 which is properly aligned and ready for gripping will have a guide flange 248 on either side, a guide flange 250 at one end, and two bladder grippers 244 at the other end. In this manner, guide flanges 248 and 250 aid bladder grippers 244 to remove parts from dunnage trays 100 and 101.

Referring again to FIG. 3, a single file of parts 260 unloaded from a row m at 82 of compartments 86 on dunnage tray 100 or 101 is transported to additional workstations by transport conveyor 198.

After all rows m of compartments 86 have been unloaded of their parts, conveying curtain 158 conveys the now empty dunnage tray 262 or empty tray 263 with attached mother pallet 254 further along path $y_0$. The movement of empty dunnage tray 262 or empty tray with attached mother pallet 254 is eventually restrained by restraining bar 264 (see FIGS. 2 and 4), while conveying curtain 158 continues to move further along path $y_0$ to thereby wipe empty dunnage tray 262 or empty tray with attached mother pallet 254 onto lowerating platform 30, which is lowered in preparation of receiving the next empty dunnage tray 262 or 263.

Lowerating platform 30 includes an empty dunnage tray 263 with attached mother pallet 265 from a previous stack 78. Thus both stack 78 and restacked stack 266 have mother pallets 80 and 265 with respective attached dunnage trays 73 and 263.

After k number of empty dunnage trays 262 have been restacked, lowerating platform 30 lowers restacked stack 266 along a vertical path $z_1$ indicated at 268, which is substantially parallel to vertical path $z_0$, to discharge conveyor 60. Discharge conveyor 60 conveys restacked stack 266 along a path $x_1$ indicated at 270, which is substantially parallel to path $x_0$, to an output station 272 at the end of discharge conveyor 60. Meanwhile, conveying curtain 158 continues to circulate first downwardly and parallel to path $z_1$, then along a path $y_1$ indicated at 274 substantially parallel to path $y_0$, then upwardly and parallel to path $z_0$, and finally along path $y_0$ again to convey the next dunnage tray 100 from capturing station 102 to unloading station 190.

Referring now to FIG. 11, the operation of controller 40 is schematically illustrated. Controller 40 receives input along lines 278, 280, and 282 from capture sensor 103, keyboard 276, and unload sensor 191 respectively. Controller 40 may for example be provided as either a hard-wired or software driven computer, or more simply as an array of logic switches. Based on the inputted data, controller 40 directs the operation of a variety of peripheral devices. Such peripheral devices may include, in accordance with the preferred embodiment, scissors lift 36, scissors lift 38, curtain motor 170, discharge motor 62, infeed motor 52, vertical cylinder 208, vertical cylinder 210, lateral cylinder 202, capture cylinder 146, capture cylinder 144, and grippers 244. The function of all of these peripheral devices is more completely described elsewhere in the description of the apparatus and method.

Figure 12:
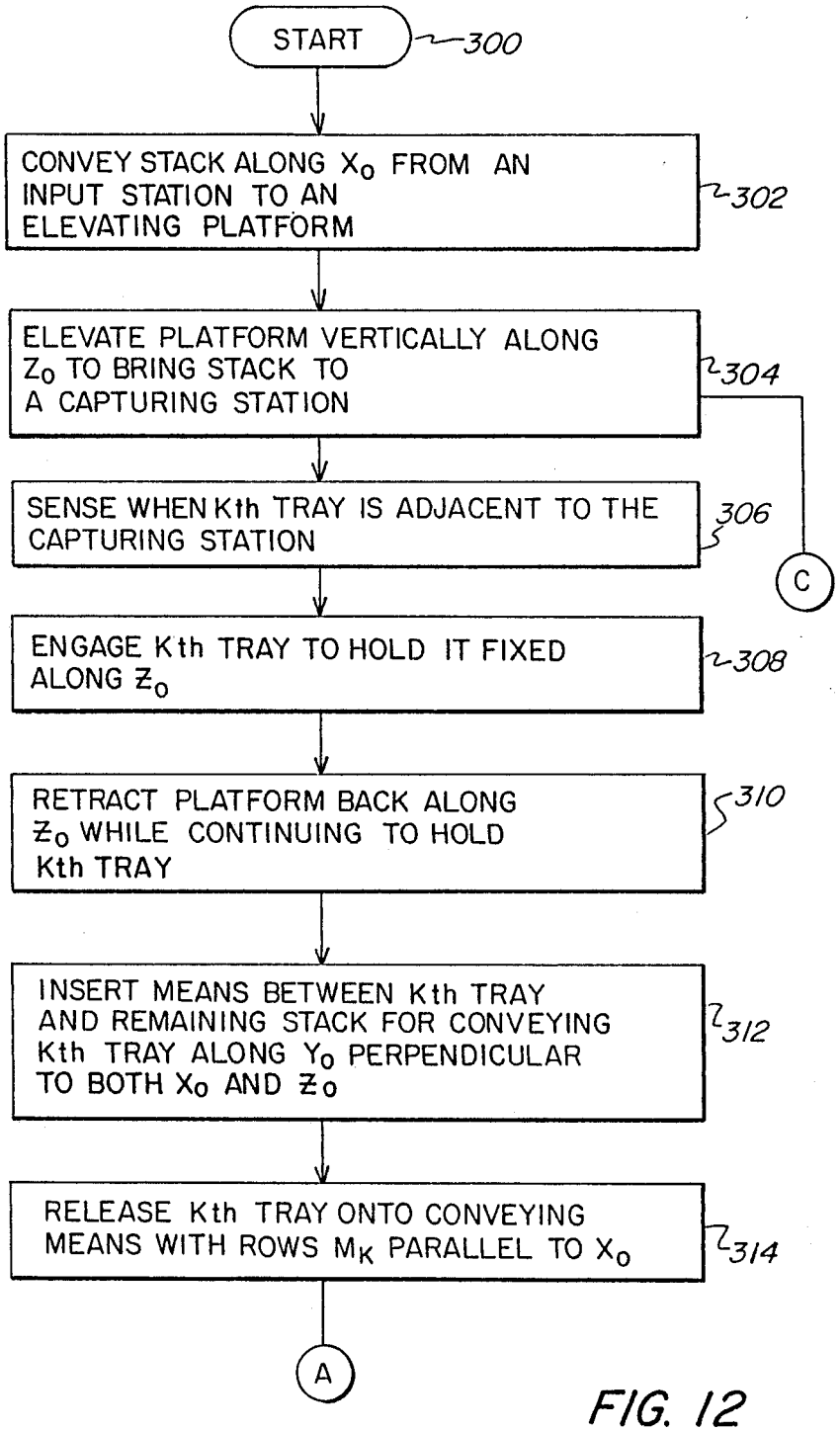
FIGS. 12 through 14 are flow diagrams of the preferred method of this invention.
Figure 13:
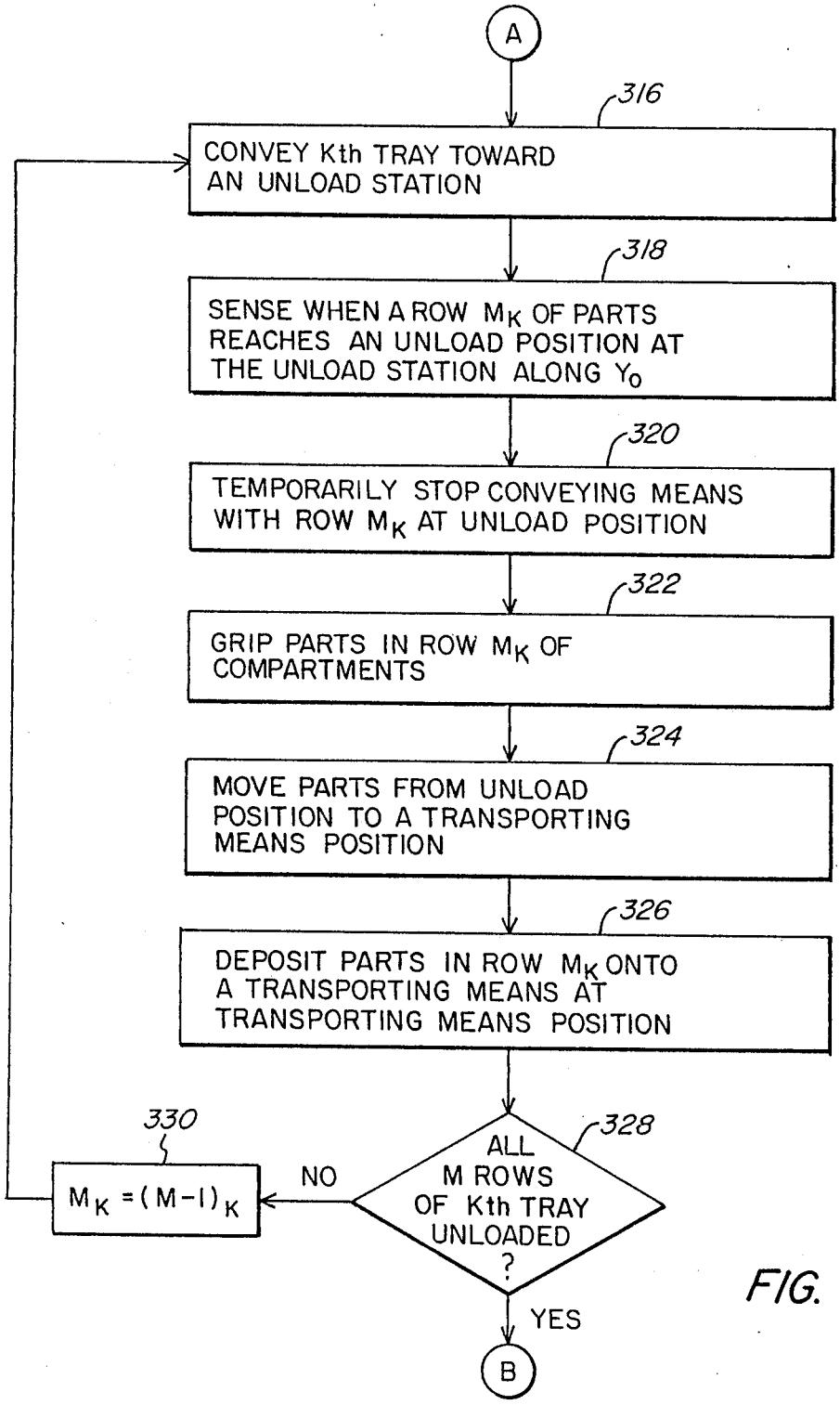
Figure 14:
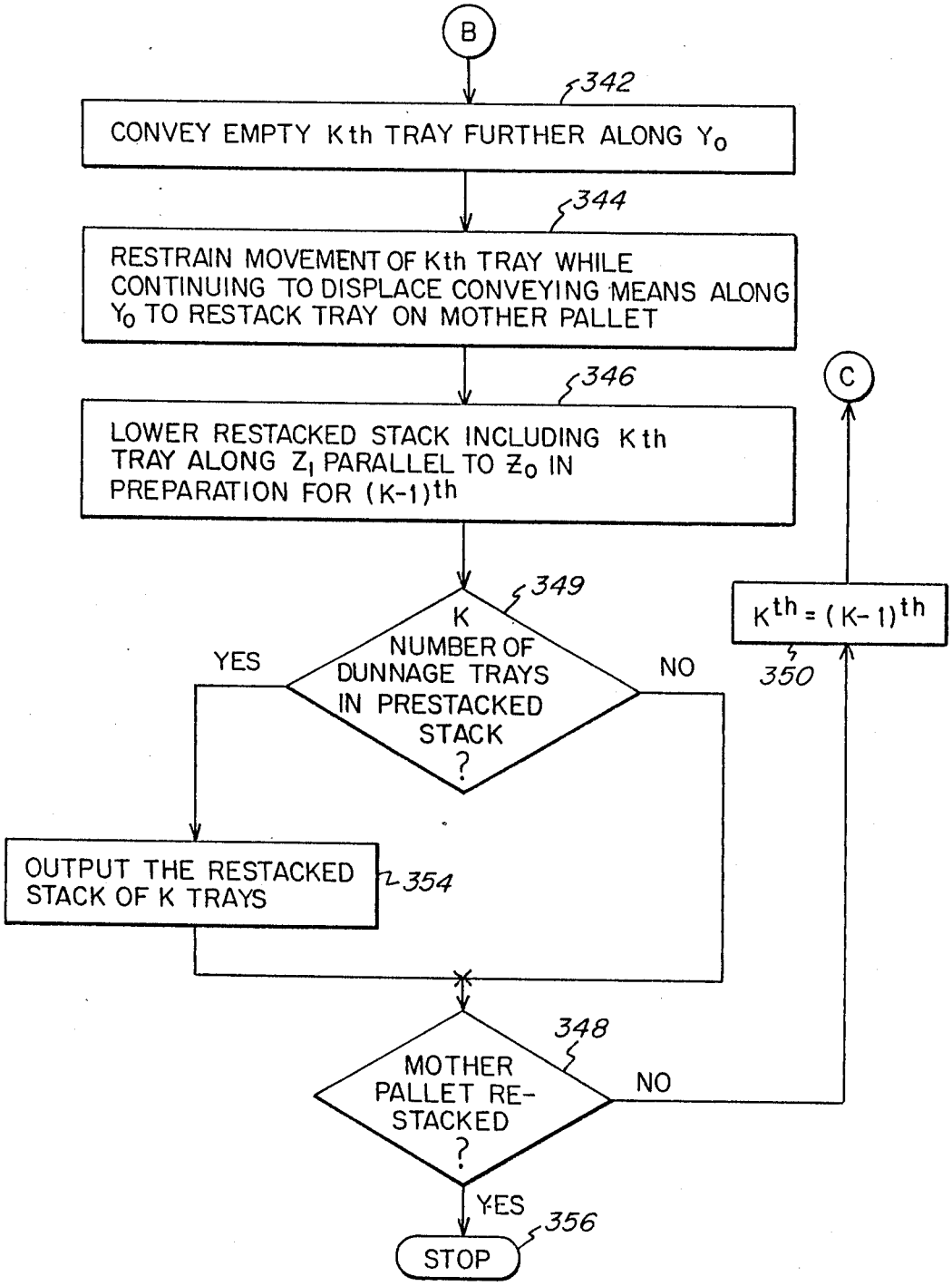

Referring now to FIGS. 12 through 14 in combination with the FIGS. 1 through 10 as described above, a preferred embodiment of the method of the present invention for handling a dunnage tray and unloading at least one part therein is illustrated as a flow diagram.

At box 300, vertical stack 78 of k dunnage trays 72, each containing parts 74 in a matrix of m number of parallel rows 82 and n number of parallel columns 84 of compartments 86 at input station 76. It is understood that the method of the present invention is applicable even though the matrix positions are not completely filled with parts. Bottom tray 73 is preferably fixedly attached to mother pallet 80.

Stack 78 is conveyed along path $x_0$ from input station 76 to elevating platform 28. At box 304, stack 78 is elevated with elevating platform 28 along path $z_0$ to capturing station 102. At box 306, capture sensor 103 senses when $k^{th}$ dunnage tray 100 or 101 is adjacent to capturing station 102. Once dunnage tray 100 or 101 is adjacent to capturing station 102, engaging means such as bars 104 and 106 move inwardly in parallel fashion with teeth 112 to hold dunnage tray 100 beneath its lip 115 in the substantially fixed position along path $z_0$. Alternatively, bars 104 and 106 move inwardly in parallel fashion with teeth 114 to hold mother pallet 80 and attached dunnage tray 101 in the same substantially fixed position along path $z_0$.

Elevating platform 28 and stack 78 of remaining dunnage trays 72, if any, is retracted back along path $z_0$ while dunnage tray 100 or 101 continues to be held in the substantially fixed position as illustrated at box 310. Next, at box 312, conveying means 158 is inserted between dunnage tray 100 or 101 and retracted elevating platform 28 to convey dunnage tray 100 or 101 along path $y_0$. Dunnage tray 100 or 101 is released at box 314 onto conveying means 158 with rows $m_k$ of compartments 86 substantially parallel to path $x_0$.

At box 316, dunnage tray 100 or 101 is conveyed with conveying means 158 along path $y_0$ toward unloading station 190 until a part 74 in a row 82 of compartments 86 is sensed by unload sensor 191 at box 318 as reaching unloading position B at unloading station 190. When part 74 reaches unload position B at unload station 190, conveying means 158 is temporarily stopped as illustrated at box 320. Parts 74 in row 82 of compartments 86 are gripped at box 322, and then moved at box 324 from unload position B to transporting means position D. Then at box 326, part 74 is deposited onto transporting means 198 at transporting means position D.

If all m rows 82 of dunnage tray 100 or 101 are not unloaded, the method continues at box 330 where m is assigned the value of (m−1), and at box 316, where row m of dunnage tray 100 or 101 is again aligned at unload station 190. Once all m rows of compartments 86 in dunnage tray 100 or 101 are unloaded, the method continues at box 342 and empty dunnage tray 262 or 263 is conveyed further along path $y_0$ by conveying means 158.

At box 344, empty dunnage tray 262 or 263 is restrained by restraining means 264 while conveying means 158 continues to displace still further along path $y_0$. Empty dunnage tray 262 or 263 is thus effectively wiped off conveying means 158 onto lowerating platform 30. Dunnage tray 262 is restacked onto restacked stack 266 containing at least empty dunnage tray 263 with attached mother pallet 265 from a previous stack 278. Dunnage tray 263 with attached mother pallet 265, however, is restacked directly onto tray support 34 of lowerating platform 38. Once the empty dunnage tray 262 or 263 has been restacked they are lowered at box 346 along path $z_1$ in preparation for receiving the $(k-1)^{th}$ empty dunnage tray 262.

Assuming now that dunnage tray 262 has just been restacked, if k number of dunnage trays are restacked on restacked stack 266, restacked stack 266 is outputted at box 354 to output station 272. After outputting restacked stack 266 or if k number of dunnage trays have not yet been restacked, the method continues at box 350 where k is assigned the value of (k−1) and stack 78 is again elevated to bring dunnage tray 72 or 73 to capturing station 102. Once dunnage tray 73 with attached mother pallet 80 has been restacked, the method stops at box 356 unless restarted with a new stack 78.

The above description is for the purpose of teaching a person skilled in the art how to make and use the invention. This description is not meant to describe in detail each and every modification and variation which will be apparent to the skilled worker; however, it is meant to include all such modifications and variations within the scope of the following claims.

What is claimed is:

1. A device for unloading parts from a plurality of stacked trays, said device comprising:

(a) a receiving station having elevator means for lifting and lowering said stack along a vertical path above said receiving station, said elevator means for lifting a topmost tray of said stack to a predetermined vertical position;

(b) means for temporarily holding said topmost tray at said predetermined vertical position while said elevator means lowers the remaining trays in said stack below said vertical position to provide at least a preselected distance between said topmost tray and said stack;

(c) conveying means for moving from an initial position to a position below said topmost tray but above said stack, said holding means further for releasing said topmost tray onto said conveying means when said conveying means is positioned between said topmost tray and said stack, said conveyor means further for conveying said topmost tray under an unloading station;

(d) means disposed at said unloading station positioned above said topmost tray for removing said parts from said topmost tray as said conveying means moves said topmost tray thereunder;

(e) means attached to said conveying means, for locating said topmost tray in an aligned position relative with said removing means, said locating means for engagement with the bottom of said topmost tray;

(f) means for receiving said topmost tray after unloading; and (g) said conveying means further for returning to said initial position after unloading of said topmost tray to receive the next tray in the stack for conveying to said unloading station after said next tray has been lifted to said vertical position.

2. The device of claim 1 wherein said receiving means comprises additional elevator means accepting each such tray after unloading for restacking said trays in reverse order upon a mother pallet with attached tray from a previous stack, said additional elevator means also for lowering an empty tray stack to an empty tray discharge station.

3. The device of claim 2 wherein said conveying means moves along a path above said additional elevator means after carrying each said tray through said unloading station, and said device further comprises means for engaging the tray as said conveying means is moving above said additional elevator means to restrain said tray against following said conveyor means, said tray having the conveying means moving out from under said tray to deposit said tray on said additional elevator means.

4. The device of claim 1, wherein each said tray includes lip means formed around the perimeter thereof, and said holding means comprises a pair of first finger means, each disposed on opposing sides of said tray, said first finger means being extendable from a retracted position for permitting the lifting of said stack to said vertical position to an extended position for engaging said topmost tray on opposing sides thereof under said lip means for holding said topmost tray at said position while said elevating means is lowered to provide said preselected distance.

5. The device of claim 4, wherein each said stack rests upon a mother pallet, and said holding means further comprises a second pair of finger means, each disposed on opposing sides of said mother pallet, said second finger means being extendable from a retracted position for permitting the lifting of said stack to said vertical position to an extended position for engaging said mother pallet to hold it at said position while said elevating means is lowered to provide s id preselected distance.

6. The device of claim 1 wherein said locating means comprises alignment lugs, and wherein each said tray includes slot means formed on the bottom thereof, said slot means being oriented so that as said conveying means moves from said initial position to said position below said topmost tray, said locating means engages said slot means to align said topmost tray when it is released from said holding means onto said conveying means.

7. The device of claim 1 wherein said conveying means further comprises means for temporarily stopping said conveying means to bring each said article from said topmost tray to a removing position directly below said removing means for unloading said article, said temporary stopping means also for restarting said conveying means after said article has been removed.

8. The device of claim 1 including means located above said conveying means for outputting said parts as they are unloaded from said topmost tray by said removing means to an additional workstation, said outputting means being located above and adjacent said unloading station.

9. The device of claim 8 wherein said removing means further comprises means for gripping each said article from said uppermost tray as said uppermost tray is conveyed thereunder, and still further comprises means for transporting each said gripped article from said uppermost tray to said outputting means.

10. The device of claim 9 wherein said gripping means further comprises means for guiding each said part between a plurality of bladder means arranged around each said part, said bladder means being inflatable for expanding to contact the periphery of said part thereby retaining said part for unloading, said bladder means further for deflating to place said part onto said outputting means.

11. The device of claim 5 wherein said first and second pairs of finger means protrude inwardly from a pair of substantially parallel bar means, said bar means each having means for moving from said retracted position to said extended position in a parallelogram fashion to engage said topmost tray.

12. The device of claim 1 wherein said conveying means further comprises a curtain of slat means, said slat means having their ends attached to means for driving said conveying means, said slat means also having their sides in relative abutment to support said topmost tray.

13. A method of unloading parts from k number of dunnage trays (1, 2, ..., k−1, k) stacked vertically, each of said dunnage trays containing parts stored therein in at least selected ones of a matrix arrangement of m number of substantially parallel rows of compartments and n number of substantially parallel columns of compartments, said method comprising the steps of:

(a) conveying said stack of dunnage trays along a path $x_0$ from an input station to an elevating platform, said rows being aligned substantially parallel to said path $x_0$;

(b) elevating said platform to lift said stack of dunnage trays along a vertical path $z_0$ substantially perpendicular to said path $x_0$ to a capturing station;

capturing the $k^{th}$ tray to hold said dunnage tray in a substantially fixed position along said vertical path $z_0$;

(d) retracting said platform to lower said stack of dunnage trays back along said vertical path $z_0$ while continuing to hold said $k^{th}$ dunnage tray in said substantially fixed position to thereby effect separation of said $k^{th}$ dunnage tray from the remaining dunnage trays of said stack; (e) inserting means between said $k^{th}$ dunnage tray and said remaining dunnage trays of said stack for conveying said $k^{th}$ dunnage tray along a path $y_0$ substantially perpendicular to said paths $x_0$ and $z_0$ for unloading said parts;

(f) releasing said $k^{th}$ dunnage tray onto said conveying means in a position aligned relative to an unload station;

(g) indexing said conveying means along said path $y_0$ to bring each row of said $k^{th}$ dunnage tray to an unload position at said unload station, said unload position being defined by a fixed area along said path $y^0$;

(h) unloading said parts in said row of said compartments substantially simultaneously from said $k^{th}$ dunnage tray;

(i) repeating steps (g) and (h) for each of the remaining rows until the last row of said $k^{th}$ dunnage tray has been unloaded;

(j) after said last row is unloaded, then conveying the $k^{th}$ empty dunnage tray further along said path $y_0$ to a means for restraining the movement of said $k^{th}$ empty dunnage tray therebeyond;

(k) restraining the movement of said $k^{th}$ empty dunnage tray along said path $y_0$ while continuing to displace said conveying means further along said path $y_0$, thereby wiping said $k^{th}$ empty dunnage tray off of said conveying means and onto a lowerating platform;

(l) lowering said lowerating platform back along a path $z_1$ substantially parallel to said path $z_0$ in preparation for receiving the empty dunnage tray;

(m) if k number of dunnage trays are on restacked stack then lowering said empty dunnage trays restacked (k, k−1, ..., 2, 1) substantially further back along said path $z_1$ to a path $x_1$ substantially parallel to said path $x_0$, and conveying said restacked empty dunnage trays from said lowerating platform back along said path $x_1$ to an output station; and (n) repeating said steps (b) through (m) for each of the remaining dunnage trays (k−1, ..., 2, 1) until the last dunnage tray has been restacked.

14. The method of claim 13 wherein said capturing step further comprises:

(a) sensing when said $k^{th}$ dunnage tray being lifted by said elevating platform is adjacent to said capturing station; and (b) engaging said $k^{th}$ dunnage tray to hold said $k^{th}$ dunnage tray in said substantially fixed position along said path $z_0$.

15. The method of claim 14 wherein said engaging step further comprises actuating two engaging means inwardly, to hold said $k^{th}$ dunnage tray, each said engaging means being on opposite sides of the dunnage tray and being substantially parallel to the other.

16. The method of claim 15 wherein said releasing step further comprises deacuating said two engaging means outwardly away from said $k^{th}$ dunnage tray to release said dunnage tray onto said conveying means in said aligned position.

17. The method of claim 16 wherein said indexing step further comprises:

(a) conveying said $k^{th}$ dunnage tray forwardly along path $y_0$;

(b) sensing when said parts in each said row of compartments reach said unload position; and (c) temporarily stopping said conveying means when as said parts in said row are sensed to be at said unload position.

18. The method of claim 17 wherein said unloading step further comprises:

(a) gripping said parts in each said row of compartments in seriatim with means for gripping and lifting said parts from said dunnage tray;

(b) moving said parts to means for transporting said parts to at least one additional work-station; and (c) depositing said parts onto said transporting means at a transporting means position.

19. The method of claim 16 wherein said moving step further comprises:

(a) displacing said gripping means along a path parallel to $z_0$ between said unload position and said transporting means position and displacing said gripping means along a path parallel to $y_0$ between said unload position and said transporting means position; and (b) displacing said gripping means further along a path parallel to $z_0$ between said transporting means position and a gripping means clear position located far enough above said transporting means position to fully disassociate said gripping means from said unloaded parts upon said transporting means.

20. The method of claim 19 wherein said gripping means further comprises a plurality of inflatable bladder means corresponding to said parts.

21. The method of claim 20 wherein said gripping step further comprises inflating said plurality of inflatable bladder means corresponding to said parts to cause said plurality of inflatable bladder means to expand in a manner to grip said parts.

22. The method of claim 21 wherein said depositing step further comprises deflating said plurality of inflatable bladder means to release said parts onto said transporting means.

23. Apparatus for unloading parts from dunnage trays stacked vertically, each of said trays containing parts stored therein in at least selected ones of substantially parallel rows of compartments, and restacking said empty dunnage trays for efficient handling, said apparatus comprising:

(a) means for lifting said stack along a first vertical path between an input station and a capturing station;

(b) means for capturing each dunnage tray on the top of the stack in seriatim to hold said dunnage tray in a substantially fixed position along said first vertical path;

(c) first means for lowering said stack back along said first vertical path for a predetermined distance while continuing to hold said top dunnage tray in said substantially fixed position to thereby effect separation of said top dunnage tray from the remaining dunnage trays of said stack;

(d) means for conveying said top dunnage tray along a second path substantially perpendicular to said first path for unloading said parts;

(e) means for inserting said conveying means between said top dunnage tray and said remaining dunnage trays of said stack;

(f) means for releasing said top dunnage tray onto said conveying means in a position aligned relative to an unload position, said unload position being defined by a fixed area along said second path;

(g) means for indexing said conveying means along said second path to bring successive rows of said top dunnage tray to said unloading position;

(h) means for unloading said parts in each said row of compartments on said top dunnage tray as rows are successively indexed to said unload position until the last row of said parts is unloaded;

(i) means for restacking the empty top dunnage tray onto a lowerating platform, said restacking means including means for restraining the movement of said top empty dunnage tray further along said second path while continuing to displace said conveying means further along said second path, thereby wiping said top empty dunnage tray off of said conveying means to fall onto said lowerating platform;

(j) second means for lowering said restacked empty dunnage trays back along a third path substantially parallel to said first path, said second lowering means being controllable to lower said restacked empty dunnage trays for a distance approximating the height of each said empty dunnage tray in preparation for receiving the next empty dunnage tray; and (k) means for controlling said apparatus to repeat the unloading of each of the remaining dunnage trays until the last dunnage tray has been restacked.

24. The apparatus of claim 23 wherein said capturing means further comprises:

(a) means for engaging each said top dunnage tray, said engaging means being configured to engage each said top dunnage tray on opposite sides thereof;

(b) first sensing means for sensing when each said top dunnage tray has been lifted by said stack lifting means into alignment with said engaging means; and (c) means for actuating said engaging means to hold each said top dunnage tray in said substantially fixed position.

25. The apparatus of claim 24 wherein said actuating means further comprises a rod and cylinder assembly pivotally attached to said engaging means, said rod and cylinder assembly further controllable by said controlling means.

26. The apparatus of claim 23 wherein said conveying means further comprises:

(a) means for driving said conveying means in a direction substantially defined by said second path;

(b) curtain means including individual slat means, each said slat means being fixed at either end to said driving means for substantially continuous circulation of said curtain means along said second path;

(c) alignment lugs attached to preselected ones of said slat means for engaging each said top dunnage tray to align said tray upon said curtain in relation to said unload station.

27. The apparatus of claim 23 wherein said unloading means further comprises:

(a) second means located at said unloading position for sensing when at least one row of parts of said top dunnage tray has reached said unload position;

(b) means for transporting the unloaded parts to additional workstations, said transporting means being situated at a transporting means position, said transporting means being positioned above said unload position a distance $d_0$ in a direction substantially parallel to said paths $z_0$ and $z_1$ and adjacent said unloading position a distance $d_2$ in a direction substantially parallel to said paths $y_0$ and $y_1$;

(c) means movable between both said unload position and said transporting means position for gripping said parts; and (d) means for moving said unloading head between said unload position and said transporting means position for unloading said parts to said transporting means.

28. The apparatus of claim 27 wherein said moving means further comprises:

(a) first means for displacing said gripping means said distance $d_0$ vertically between said unload position and said transporting means at said transporting means position;

(b) second means for displacing said gripping means a distance $d_1$ in a direction substantially parallel to said first and second paths in addition to said distance $d_0$ in said same vertical direction between said moving means at said transporting means position and a gripping means clear position above said transporting means position; and (c) third means for displacing said unloading head said distance $d_2$ laterally between said unloading position and said transporting means at said transporting means position.

29. The apparatus of claim 27 wherein said gripping means further comprises inflatable bladder grippers for gripping each said part in said row of compartments.

30. The apparatus of claim 26 wherein said drive means further comprises two continuous drive chains, each said chain aligned substantially parallel to the other, and both said chains driven simultaneously by four two pairs of sprockets, each said pair of sprockets having a common axle.

31. A method for unloading a part from each of a stack of trays comprising the steps of:

(a) lifting the stack of trays to bring a topmost tray of the stack from an input station to a predetermined vertical position;

(b) holding the topmost tray at the predetermined vertical position while lowering the remaining trays in the stack at least a preselected distance;

(c) proving a conveyor means for conveying the topmost tray from the predetermined vertical position to an output station;

(d) moving the conveyor means from an initial position to a position below the topmost tray but above the stack;

(e) providing means attached to the conveyor means for engagement with the bottom of the topmost tray to located a tray loaded thereon in an aligned position relative to an unloading station;

(f) loading the topmost tray onto the conveyor means in the aligned position relative to the unloading station by engaging the bottom of the topmost tray;

(g) conveying the aligned topmost tray to the unloading station;

(h) removing the part from the topmost tray;

(i) conveying the empty topmost tray to the output station; and (j) returning the conveyor means to the initial position to receive the next topmost tray in the stack for conveying to the unloading station.

32. The method of claim 31 wherein each of the trays include slot means on the bottom thereof, and wherein the engagement means comprises alignment lugs, and wherein step (f) comprises loading the topmost tray onto the conveyor means in an aligned position relative with the unloading station by moving the conveyor means from the initial position to the position below the topmost tray but above the stack such that the alignment lugs engage the topmost tray's slot means.

* * * * *